US009016843B2

(12) United States Patent
Nishiyama et al.

(10) Patent No.: US 9,016,843 B2
(45) Date of Patent: Apr. 28, 2015

(54) INKJET PRINTER

(71) Applicant: Riso Kagaku Corporation, Tokyo (JP)

(72) Inventors: Akira Nishiyama, Ibaraki (JP); Tomoyuki Akiyama, Ibaraki (JP); Hiroshi Sugitani, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/327,061

(22) Filed: Jul. 9, 2014

(65) Prior Publication Data

US 2015/0022572 A1 Jan. 22, 2015

(30) Foreign Application Priority Data

Jul. 17, 2013 (JP) ..... 2013-148371

(51) Int. Cl.
*B41J 2/18* (2006.01)
*B41J 2/175* (2006.01)
*B41J 2/045* (2006.01)

(52) U.S. Cl.
CPC ..... *B41J 2/0454* (2013.01); *B41J 2/17566* (2013.01); *B41J 2/18* (2013.01); *B41J 2/17596* (2013.01)

(58) Field of Classification Search
CPC ..... B41J 2/18
See application file for complete search history.

(56) References Cited

U.S. PATENT DOCUMENTS

2007/0252860 A1* 11/2007 Nitta et al. ..... 347/14
2009/0174735 A1* 7/2009 Yamada ..... 347/7
2013/0135368 A1* 5/2013 Kobayashi et al. ..... 347/7

FOREIGN PATENT DOCUMENTS

JP 2011-213028 10/2011

* cited by examiner

*Primary Examiner* — Shelby Fidler
(74) *Attorney, Agent, or Firm* — Greenblum & Bernstein, P.L.C.

(57) ABSTRACT

A determiner determines whether a total ink amount in an ink circulation passage calculated by an ink amount calculator is less than an ink circulation necessary amount being an amount necessary for circulation of ink in the ink circulation passage, when a liquid level detector detects that a liquid level of the ink in an ink tank is lower than a liquid level corresponding to an ink circulation standard amount being a standard for ink circulation. A controller performs ink supply amount control to supply the ink from an ink bottle to the ink tank in such an amount that the total ink amount is kept below the ink circulation standard amount, when the determiner determines that the total ink amount is less than the ink circulation necessary amount.

2 Claims, 6 Drawing Sheets

INKJET PRINTER

CROSS REFERENCE TO RELATED APPLICATION

This application is based upon and claims the benefit of priority from the prior Japanese Patent Application No. 2013-148371, filed on Jul. 17, 2013, the entire contents of which are incorporated herein by reference.

BACKGROUND

1. Technical Field

The disclosure relates to an inkjet printer with an ink circulation system configured to circulate ink.

2. Related Art

A general inkjet printer prints images, characters, and the like by ejecting ink from nozzles of inkjet heads to a print sheet.

Among such inkjet printers, there is known an inkjet printer provided with an ink circulation system which constantly circulates the ink in order to remove foreign matters such as dusts mixed in the ink and to uniformly heat the ink.

The ink used in the inkjet printers with the ink circulation system typically has temperature characteristics in which the viscosity changes depending on a temperature condition, i.e., the viscosity is high at low temperature and is low at high temperature. Moreover, depending on the viscosity of the ink, an increase in an amount of mist generated by ejection and variations in diameter of an ink drop and ejection speed may occur, so that a printed object with high definition cannot be obtained in some cases.

Accordingly, the temperature of the ink needs to be adjusted to such a level that the ink can have an appropriate viscosity.

Japanese Unexamined Patent Application Publication No. 2011-213028 proposes an inkjet printer which includes an ink circulation passage where to circulate ink between an upper tank and a lower tank and which controls a total circulation amount of the ink circulating through the ink circulation passage on the basis of liquid levels measured by three liquid level meters provided in each of the upper tank and the lower tank, in order to reduce a time necessary for completion of a warm-up operation (necessary for temperature adjustment of the ink). Specifically, each of the upper tank and the lower tank includes a first upper-limit liquid level detector, a second upper-limit liquid level detector, and a lower-limit liquid level detector as the liquid level meters. The inkjet printer controls the liquid level to a first liquid level by using detection values obtained by the first upper-limit liquid level detector and the lower-limit liquid level detector and controls the liquid level to a second liquid level by using detection values obtained by the second upper-limit liquid level detector and the lower-limit liquid level detector.

SUMMARY

In the inkjet printer described in Japanese Unexamined Patent Application Publication No. 2011-213028, the total circulation amount of the ink circulating in the ink circulation passage is controlled based on the liquid levels measured by the three liquid level meters provided in each of the upper tank and the lower tank. Accordingly, three liquid level meters need to be provided in each of the upper tank and the lower tank. Moreover, even if the liquid level is controlled to be either one of the first liquid level and the second liquid level, at least two liquid meters need to be provided in each of the upper tank and the lower tank and the configuration of the apparatus is complex.

An object of the present invention is to provide an inkjet printer capable of adjusting the ink circulation amount and reducing the time necessary for adjusting the ink to an appropriate temperature in a simple configuration.

An inkjet printer in accordance with some embodiments includes: an inkjet head configured to eject ink to a print medium; an ink circulation passage including an ink tank configured to store the ink, the ink circulation passage being configured to circulate the ink between the inkjet head and the ink tank; a liquid level detector provided in the ink tank and configured to detect whether a liquid level of the ink in the ink tank has reached or exceeded a liquid level corresponding to an ink circulation standard amount being a standard for ink circulation; an ink bottle configured to supply the ink to the ink tank; an ink amount calculator configured to calculate a total ink amount in the ink circulation passage on a basis of the ink circulation standard amount and a consumption amount of the ink ejected by the inkjet head; a determiner configured to, when the liquid level detector detects that the liquid level of the ink in the ink tank is lower than the liquid level corresponding to the ink circulation standard amount, determine whether the total ink amount calculated by the ink amount calculator is less than an ink circulation necessary amount being an amount necessary for circulation of the ink in the ink circulation passage; and a controller configured to, when the determiner determines that the total ink amount is less than the ink circulation necessary amount, perform ink supply amount control to supply the ink from the ink bottle to the ink tank in such an amount that the total ink amount is kept below the ink circulation standard amount.

According to the configuration described above, when the determiner determines that the total ink amount is less than the ink circulation necessary amount, the controller supplies the ink from the ink bottle to the ink tank in such an amount that the total ink amount is kept below the ink circulation standard amount. Accordingly, it is possible to adjust the total ink amount in the ink circulation passage and reduce the time necessary for adjusting the ink to an appropriate temperature in a simple configuration. The more the total ink amount is reduced by controlling an ink amount supply operation, the more the time necessary for the temperature adjustment of the ink can be reduced.

The inkjet printer may further include: a thermometer configured to measure a temperature of the ink circulating in the ink circulation passage; and a storage unit configured to store the temperature of the ink measured by the thermometer in association with time-series change. The determiner may be further configured to determine whether the temperature of the ink stored in the storage unit has deviated from a range of an ejection appropriate temperature in a predetermined period, the ejection appropriate temperature being a temperature of the ink at which the ink has a viscosity necessary for appropriate ejection from the inkjet head. The controller may be configured to perform the ink supply amount control only when the determiner determines that the temperature of the ink has deviated from the range of the ejection appropriate temperature.

According to the configuration described above, the controller performs the ink supply amount control only when the determiner determines that the temperature of the ink has deviated from the range of the ejection appropriate temperature in the predetermined period. Accordingly, the total ink amount in the ink circulation passage can be adjusted only in an appropriate period.

DETAILED DESCRIPTION

Figure 1:
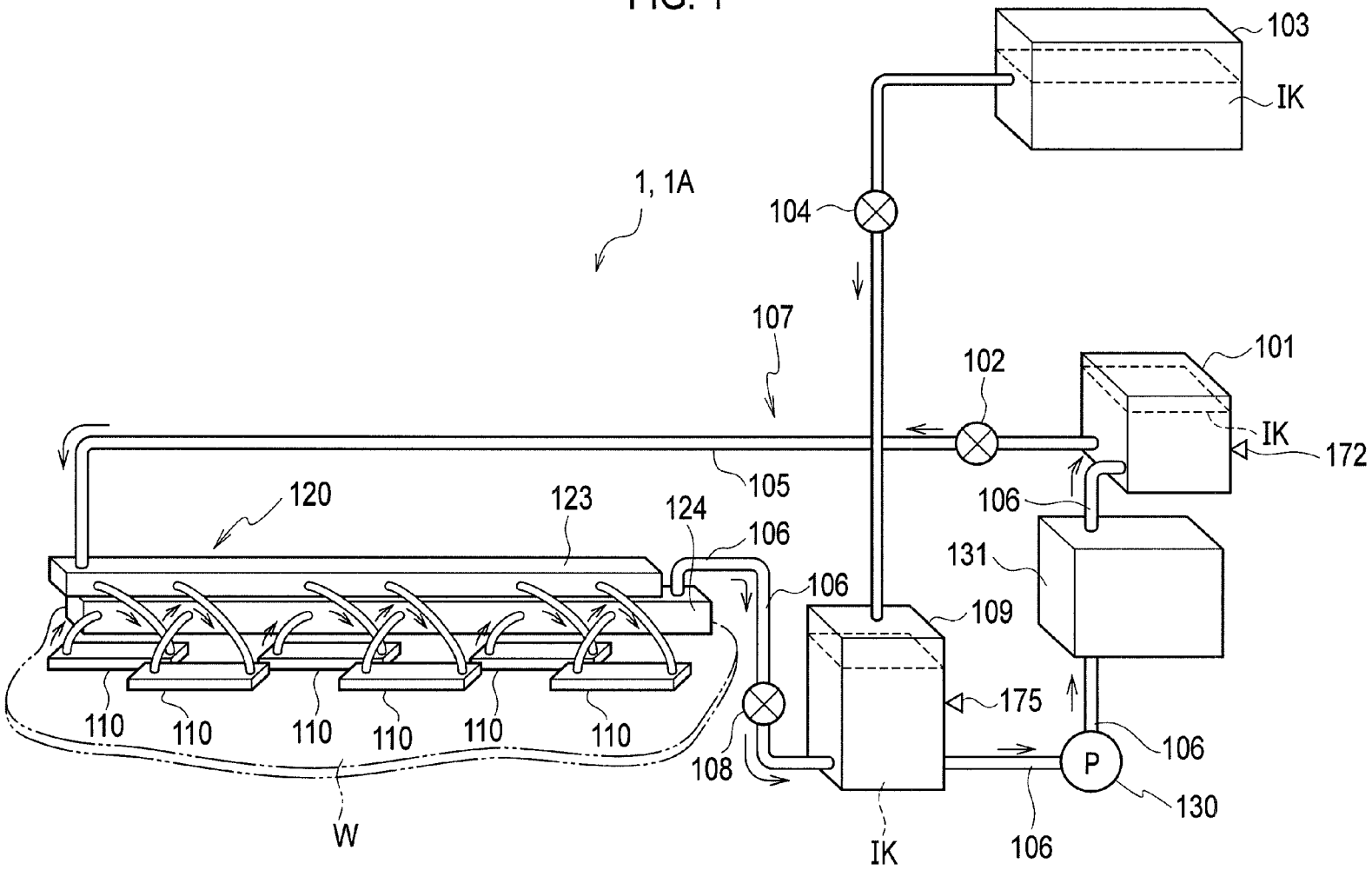
FIG. 1 is a view schematically showing an ink circulation passage in inkjet printers according first and second embodiments of the present invention where to circulate ink to be ejected from nozzles of inkjet heads.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments of the present invention are described below in detail with reference to the drawings.

FIRST EMBODIMENT

Description is given below of an inkjet printer 1 of a first embodiment of the present invention.

Configuration of Inkjet Printer 1

The first embodiment of the present invention is described by giving an example of an inkjet printer 1 with an ink circulation system which constantly circulates ink to adjust the temperature of the ink and to remove foreign matters such as dusts mixed into the ink.

FIG. 1 is a view schematically showing an ink circulation passage in the inkjet printer 1 where to circulate ink to be ejected from nozzles of inkjet heads.

As shown in FIG. 1, the inkjet printer 1 includes a first ink tank (hereafter, referred to as upper ink tank) 101 configured to store the ink IK. The upper ink tank 101 and an ink supply chamber 123 provided in an upstream portion of an inkjet head unit 120 configured to eject the ink IK are connected to each other via an ink supply passage 105. A first solenoid valve 102 is provided in the ink supply passage 105.

An ink collecting chamber 124 provided in a downstream portion of the inkjet head unit 120, a second ink tank (hereafter, referred to as lower ink tank) 109 configured to store the ink IK collected from the ink collecting chamber 124, a pump 130, a temperature adjuster 131, and the upper ink tank 101 are connected to one another via an ink collection passage 106. This connection allows the ink IK stored in the lower ink tank 109 to be delivered to the temperature adjuster 131 side when the pump 130 is driven. Moreover, the flow rate of the ink IK flowing through the ink collection passage 106 is controlled by controlling on-off of a second solenoid valve 108. The temperature adjuster 131 includes a heating unit (not illustrated) formed of a heater for heating the ink IK and a cooling unit (not-illustrated) formed of a cooling fan and a heat sink for cooling the ink IK.

In a case of circulating the ink IK through an ink circulation passage 107 including the upper ink tank 101, the ink supply passage 105, the ink collection passage 106, and the lower ink tank 109, turning on (opening) the first solenoid valve 102 and the second solenoid valve 108 which are provided in the ink circulation passage 107 causes the ink IK stored in the upper ink tank 101 to be supplied into the ink supply chamber 123 of the inkjet head unit 120 through the ink supply passage 105. Then, the ink IK is distributed from the ink supply chamber 123 to two-dimensionally-arranged multiple inkjet heads 110 and the ink IK is selectively ejected from the inkjet heads 110 onto a print sheet W.

After the ink IK is selectively ejected from the inkjet heads 110 onto the print sheet W, the excessive ink IK from the inkjet heads 110 is collected in the ink collecting chamber 124. The ink IK in the ink collecting chamber 124 is then delivered through the ink collection passage 106 and is temporarily stored in the lower ink tank 109.

Thereafter, the ink IK in the lower ink tank 109 is delivered by the pump 130 and is supplied to the upper ink tank 101 via the temperature adjuster 131.

The lower ink tank 109 is connected to an ink bottle 103 filled with the ink IK. Performing control of turning on (opening) a third solenoid valve 104 causes the fresh ink IK (i.e. not the excessive ink IK which is collected) stored in the ink bottle 103 to be supplied to the lower ink tank 109.

The upper ink tank 101 includes a liquid level detector 172 configured to detect whether the liquid level of the ink IK stored in the upper ink tank 101 has reached or exceeded a liquid level corresponding to an ink circulation standard amount Vs which is a standard for ink circulation. The ink circulation standard amount Vs indicates, for example, an ink amount with a sufficient margin for stable circulation of the ink IK in the ink circulation passage 107, and is set in advance to be greater than an ink circulation necessary amount Vn which indicates a minimum amount necessary for the circulation of the ink IK in the ink circulation passage 107.

The lower ink tank 109 includes a liquid level detector 175 configured to detect whether the liquid level of the ink IK stored in the lower ink tank 109 has reached or exceeded the liquid level corresponding to the ink circulation standard amount Vs which is the standard for ink circulation.

Specifically, the liquid level detector 172 and the liquid level detector 175 are respectively provided in the upper ink tank 101 and the lower ink tank 109 at such positions that a total ink amount Vt in the ink circulation passage 107 can be the ink circulation standard amount Vs. The total ink amount Vt is a total amount of ink circulating in the ink circulation passage 107, and is calculated as an amount obtained by adding up an ink amount in the ink supply passage 105, an ink amount in the ink collection passage 106, an ink amount stored in the upper ink tank 101, an ink amount in the inkjet head unit 120, an ink amount stored in the lower ink tank 109, an ink amount in the pump 130, and an ink amount in the temperature adjuster 131. Among these amounts, the ink amount in the ink supply passage 105, the ink amount in the ink collection passage 106, the ink amount in the inkjet head unit 120, the ink amount in the pump 130, and the ink amount in the temperature adjuster 131 are constant. Accordingly, the total ink amount Vt is determined based on the ink amount stored in the upper ink tank 101 and the ink amount stored in the lower ink tank 109.

Functional Configuration of Inkjet Printer 1

Next, description is given of a functional configuration of the inkjet printer 1.

Figure 2:
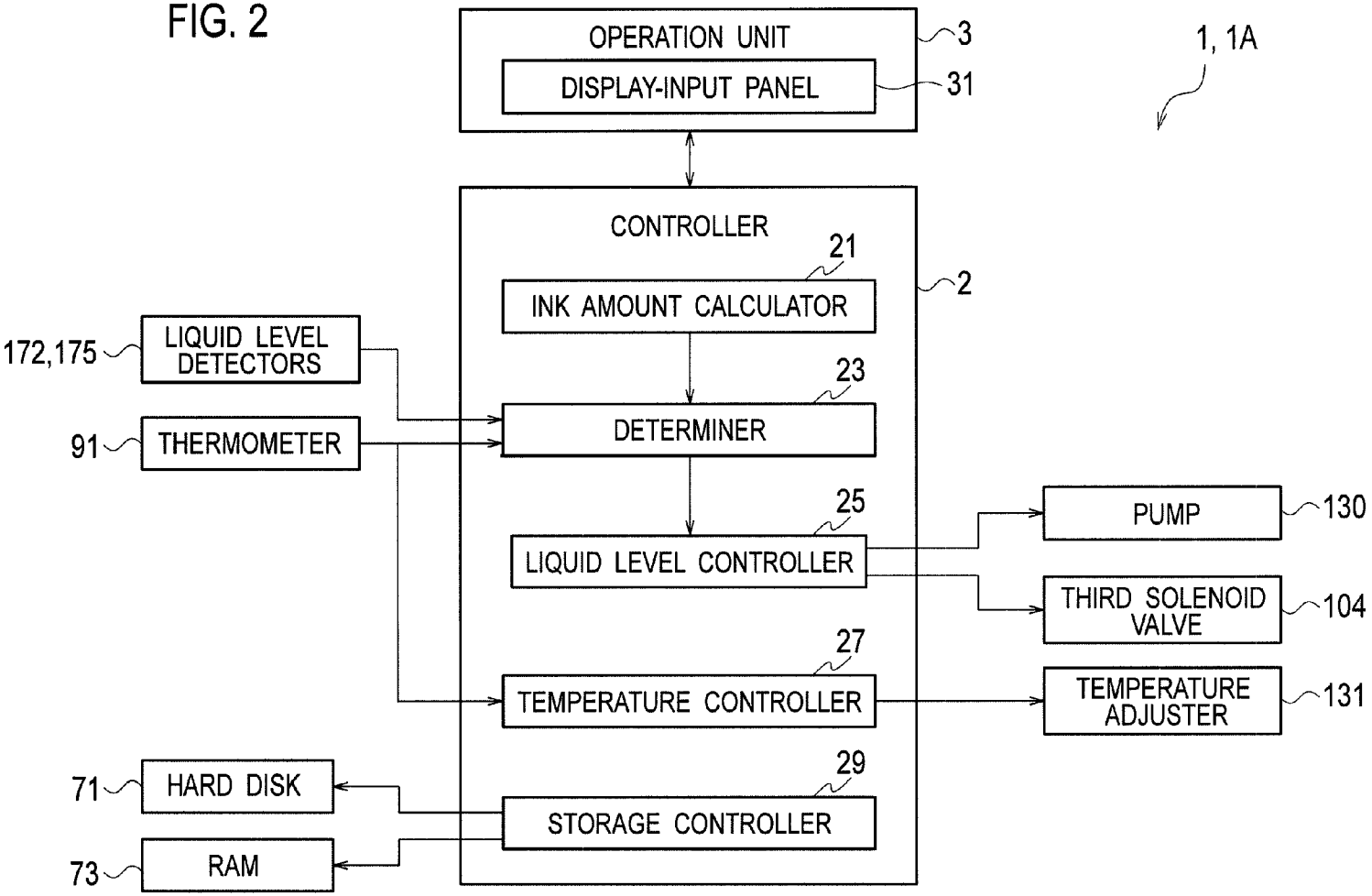
FIG. 2 is a view showing a functional configuration of the inkjet printers in the first and second embodiments of the present invention.

FIG. 2 is a view showing the functional configuration of the inkjet printer 1 of the first embodiment of the present invention.

As shown in FIG. 2, the inkjet printer 1 includes a hard disk 71, a RAM 73, the third solenoid valve 104, the pump 130, the temperature adjuster 131, an operation unit 3, a controller 2, and a thermometer 91. Among these elements, the configurations of the third solenoid valve 104, the pump 130, and the temperature adjuster 131 have been described above and description thereof is thus omitted below.

The hard disk (storage unit) 71 stores various control programs and the like to be executed by the controller 2. The hard disk 71 stores the ink circulation necessary amount Vn and a time at which a power off operation is performed. Moreover, the hard disk 71 stores ink temperatures measured by the thermometer 91 at predetermined time cycles within a period from a time of power on to the time of power off, as change in the ink temperature over time (time-series change).

The RAM 73 is formed of a non-volatile semiconductor memory or the like and stores various types of data and the various control programs to be executed by the controller 2.

The operation unit 3 is provided in an upper portion of the inkjet printer 1 and includes a display-input panel 31 and various operation keys (which are all not illustrated) such as a power key for setting a main power to an on state, a start key for starting reading, printing, and the like, a stop key for stopping reading, printing, and the like, and figure keys (not illustrated) for inputting the number of copies to be printed and the like. The operation unit 3 sends the controller 2 operation signals based on operations of a user.

The display-input panel 31 of the operation unit 3 includes a clear pressure-sensitive or electrostatic-capacitance touch panel disposed on a front side and a liquid display panel (both panels are not illustrated) disposed on a back side of the touch panel. The user can directly touch a surface of the touch panel with his/her finger while viewing a display screen of the liquid display panel and thereby perform, for example, various setting input operations such as setting of the ink circulation necessary amount Vn.

The thermometer 91 is provided in the ink circulation passage 107 and detects an ink temperature $T_1$ of the ink IK flowing in the ink circulation passage 107.

The controller 2 performs central control of the inkjet printer 1. The controller 2 functionally includes an ink amount calculator 21, a determiner 23, a liquid level controller 25, a temperature controller 27, and a storage controller 29.

The ink amount calculator 21 calculates a consumption amount of the ink ejected by the inkjet heads 110 and calculates the total ink amount Vt in the ink circulation passage 107 on the basis of the calculated ink consumption amount and the ink circulation standard amount Vs.

When the liquid levels in the upper ink tank 101 and the lower ink tank 109 are determined to be less than the liquid level corresponding to the ink circulation standard amount Vs from the detection results of the liquid level detectors 172, 175, the determiner 23 determines whether the total ink amount Vt calculated by the ink amount calculator 21 is less than the ink circulation necessary amount Vn.

The determiner 23 may also determine whether the total ink amount Vt calculated by the ink amount calculator 21 is less than the ink circulation necessary amount Vn when the ink temperature $T_1$ measured by the thermometer 91 deviates from an ejection appropriate temperature range indicating a range of the ink temperature at which ink has a viscosity necessary for appropriate ejection from the inkjet heads 110. This determination based on the ink temperature may be performed on the occasion of supplying the ink or based on a measurement result obtained in a predetermined period. The determination based on the measurement result obtained in the predetermined period may use, as determination criteria, whether the number of times the ink temperature $T_1$ deviates from the ejection appropriate temperature range in the predetermined period is N or more (N is an integer of 1 or more). Note that the predetermined period is set in advance to be, for example, latest one week or the like and is updated every day. Moreover, the ejection appropriate temperature range is a range in which the ink temperature $T_1$ is equal to or higher than a lower-limit temperature $T_L$ (for example, 25°) and is equal to or lower than an upper-limit temperature $T_H$ (for example 40° C.).

The liquid level controller 25 controls the liquid levels in the upper ink tank 101 and the lower ink tank 109 in such a way that the liquid levels are within a predetermined liquid level range.

For example, when the detection result of the liquid level detector 172 is off and the detection result of the liquid level detector 175 is on, the liquid level controller 25 turns on the pump 130 and causes the pump 130 to supply a predetermined amount of the ink IK from the lower ink tank 109 to the upper ink tank 101. At this time, the liquid level controller 25 may control the drive of the pump and control the supply amount per unit time.

By this control, the ink IK is supplied from the lower ink tank 109 to the upper ink tank 101 when the ink IK is ejected from the inkjet heads 110 and the amount of the ink IK stored in the upper ink tank 101 becomes less. This can prevent running out of ink to be ejected from the inkjet heads 110.

When the total ink amount Vt of the ink IK circulating through the ink circulation passage 107 becomes less, the liquid level controller 25 performs control of opening the third solenoid valve and supplying the ink IK from the ink bottle 103 to the lower ink tank 109 to replenish the ink IK in the ink circulation passage 107.

Figure 3:
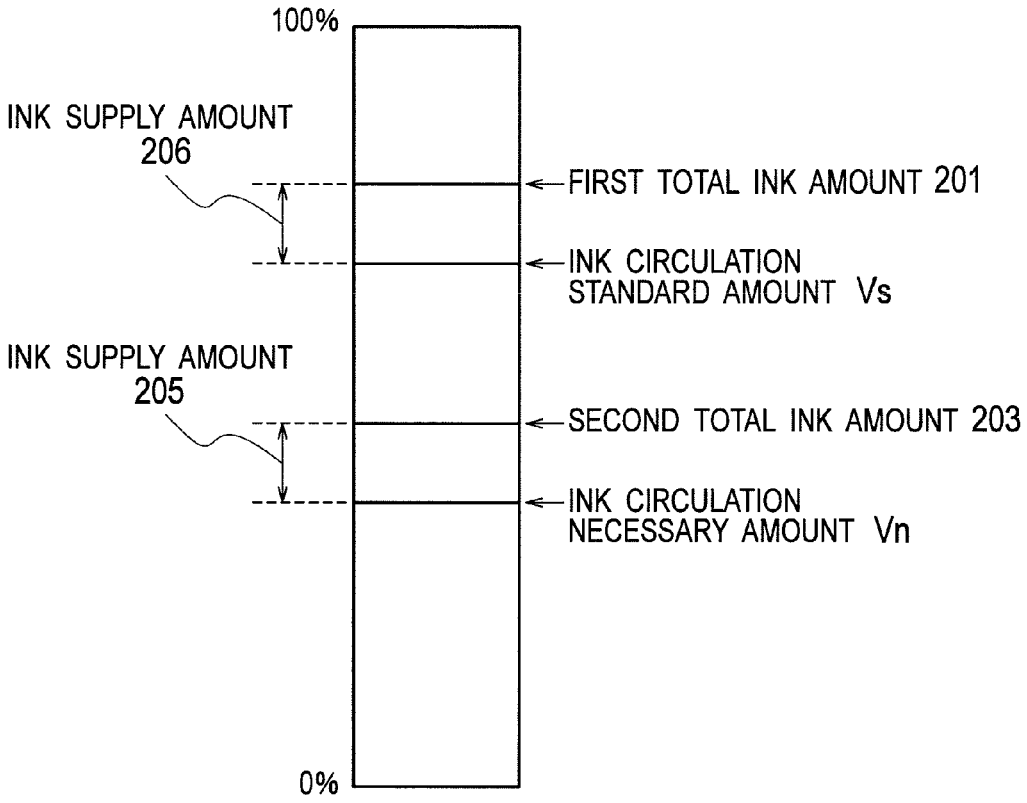
FIG. 3 is a view for explaining ink replenishment control in which the ink is supplied from an ink bottle to a lower ink tank in the inkjet printers of the first and second embodiments of the present invention.

FIG. 3 is a view for explaining ink replenishment control in which the ink is supplied from the ink bottle 103 to the lower ink tank 109 in the inkjet printer 1 of the first embodiment of the present invention. In FIG. 3, the amount of the ink IK in the ink circulation passage 107 is shown with a state where the ink circulation passage 107 including the upper ink tank 101 and the lower ink tank 109 is full of the ink IK being taken as 100(%).

When the liquid level detectors 172, 175 are off, i.e. as shown in FIG. 3, when the liquid levels of the upper ink tank 101 and the lower ink tank 109 are less than the liquid level corresponding to the ink circulation standard amount Vs, the liquid level controller 25 does not supply the ink from the ink bottle 103 to the lower ink tank 109.

Then, when the total ink amount Vt in the ink circulation passage 107 decreases due to the ejection of the ink IK and the determiner 23 determines that the total ink amount Vt is less than the ink circulation necessary amount Vn, the liquid level controller 25 executes ink supply control to supply the ink IK from the ink bottle 103 to the lower ink tank 109 only in such an ink supply amount 205 that the total ink amount Vt in the ink circulation passage 107 can be increased to a second total ink amount 203 while being kept below the ink circulation standard amount Vs.

Accordingly, the total ink amount in the ink circulation passage 107 is always kept less than Vs. Hence, even when the ink temperature deviates from the ejection appropriate temperature range due to no consumption of the ink after the ink supply, the time necessary for adjusting the ink temperature to the ejection appropriate temperature range can be reduced compared to the case where the ink is supplied to always keep the total ink amount at Vs or more.

When the ink temperature $T_1$ measured by the thermometer 91 is within the ejection appropriate temperature range, the time for adjusting the ink temperature is unnecessary. In this case, the liquid level controller 25 may execute normal ink supply control (perform ink supply in such a way that the total ink amount in the ink circulation passage 107 is equal to or greater than Vs when the total ink amount becomes less than Vn) instead of the ink supply control described above. Specifically, when the liquid level detectors 172, 175 are off, i.e. as shown in FIG. 3, when the liquid levels of the upper ink tank 101 and the lower ink tank 109 are less than the liquid level corresponding to the ink circulation standard amount Vs, the liquid level controller 25 supplies the ink IK from the ink bottle 103 to the lower ink tank 109 in such an ink supply amount 206 that the total ink amount Vt in the ink circulation passage 107 may reach a first total ink amount 201. This can secure an ink amount sufficient for stable circulation of the ink IK.

Moreover, the liquid level controller 25 may perform the ink supply amount control only when the determiner 23 determines that the ink temperature has deviated from the ejection appropriate temperature range on the basis of the change in the ink temperature over time which is stored in the hard disk 71.

For example, even if the ink temperature is within the ejection appropriate temperature range at the time of measurement, when the determiner 23 determines that the ink temperature has deviated from the ejection appropriate temperature range in the latest predetermined period, the liquid level controller 25 supplies the ink IK from the ink bottle 103 to the lower ink tank 109 only in such an ink supply amount 205 that the total ink amount Vt in the ink circulation passage 107 can be increased to the second total ink amount 203 while being kept below the ink circulation standard amount Vs.

The ink supply amount control is thus performed in advance in a case where the ink temperature frequently deviates from the ejection appropriate temperature range due to the outside temperature. Accordingly, the total ink amount in the ink circulation passage can be appropriately adjusted even in a usage method in which, for example, the power is turned off every day in the evening and is turned on in the next morning. Specifically, the power is turned off when the liquid level is controlled to make the total ink amount Vt equal to the ink circulation standard amount Vs at the ink temperature in the ejection appropriate temperature range. Then, after elapse of several hours, the power is turned on in the next morning by which the ink temperature has dropped. At this time, the ink temperature may have deviated from the ejection appropriate temperature range. However, even in this case, since the liquid level controller 25 performs the ink supply amount control when the determiner 23 determines that the ink temperature has deviated from the ejection appropriate temperature range on the basis of the change over time, it is possible to prevent a case where the adjustment of the ink temperature requires a long time.

The temperature controller 27 controls the temperature adjuster 131 in such a way that the ink temperature $T_1$ is equal to or higher than a printable lower-limit temperature $T_L$ and is equal to or lower than a printable upper-limit temperature $T_H$.

Specifically, when a temperature control cycle S2 arrives, the temperature controller 27 determines whether the ink temperature $T_1$ detected by the thermometer 91 is lower than the lower-limit temperature $T_L$. Here, the temperature control cycle S2 is a predetermined cycle at which the ink temperature is monitored while the power of the inkjet printer 1 is turned on. The lower-limit temperature $T_L$ is a lower limit temperature of the ink at which print processing is possible, and is set to, for example, 25(° C.) in advance. Then, when the temperature controller 27 determines that the ink temperature $T_1$ is lower than the lower-limit temperature $T_L$, the temperature controller 27 stops the cooling fan of the temperature adjuster 131 and causes the heating unit of the temperature adjuster 131 to start a heating operation.

Moreover, the temperature controller 27 determines whether the ink temperature $T_1$ detected by the thermometer 91 exceeds the upper-limit temperature $T_H$. Here, the upper-limit temperature $T_H$ is an upper-limit temperature of the ink at which the print processing is possible, and is set to, for example, 40(° C.) in advance.

When the temperature controller 27 determines that the ink temperature $T_1$ is higher than the upper-limit temperature $T_H$, the temperature controller 27 stops the heating operation by the heater of the temperature adjuster 131 and causes the cooling fan of the temperature adjuster 131 to start a cooling operation. The ink temperature $T_1$ can be thus controlled to be within a range between the lower-limit temperature $T_L$ and the upper-limit temperature $T_H$.

The storage controller 29 includes therein a clock, and stores, in the hard disk 71, a time timed by the clock at a point where a power off operation is performed from the operation unit 3.

Operations of Inkjet Printer 1

Next, operations of the inkjet printer 1 are described.

Figure 4:
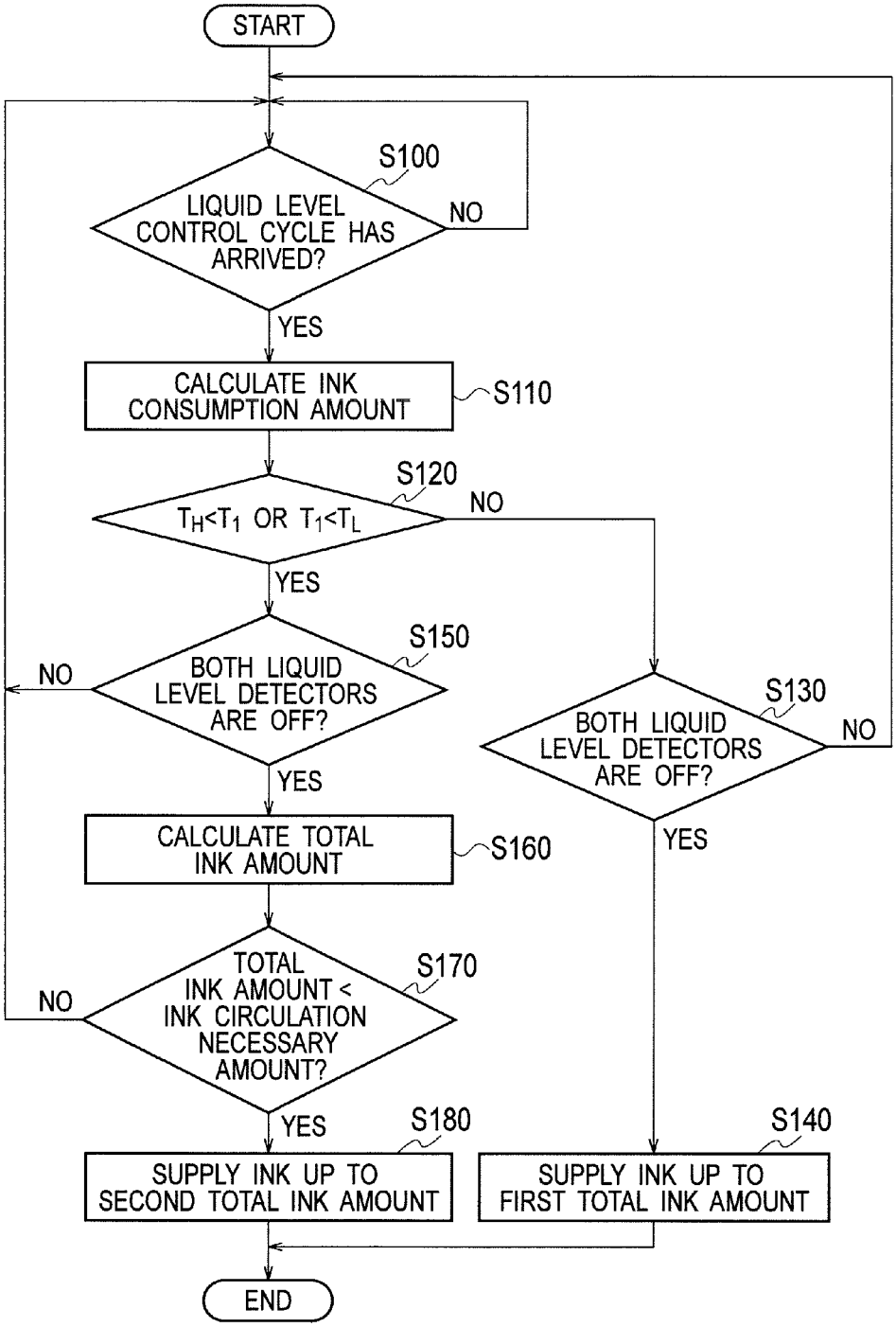
FIG. 4 is a flowchart showing a processing procedure in the inkjet printer of the first embodiment of the present invention.

FIG. 4 is a flowchart showing a processing procedure in the inkjet printer 1 of the first embodiment of the present invention.

As shown in FIG. 4, the controller 2 determines whether a predetermined liquid level control cycle S1 has arrived during printing (S100). Here, the liquid level control cycle S1 is a predetermined cycle at which the liquid level is monitored while the power of the inkjet printer 1 is turned on.

Next, when the controller 2 determines that the liquid level control cycle S1 has arrived in step S100 (YES in S100), the ink amount calculator 21 of the controller 2 calculates the consumption amount of ink ejected by the inkjet heads 110 in step S110.

Then, in step S120, the controller 2 determines whether the ink temperature $T_1$ is either lower than the lower-limit temperature $T_L$ or higher than the upper-limit temperature $T_H$. The ink temperature $T_1$ in step S120 may be a temperature measured by the thermometer 91 at the time of determination or may be the lowest ink temperature and the highest ink temperature which have been measured in the latest predetermined period and which are stored in the hard disk 71. In the case where the latter ink temperatures are used, the ink supply amount control can be executed in an appropriate period.

When the controller 2 determines that the ink temperature $T_1$ is equal to or higher than the lower-limit temperature $T_L$ and is equal to or lower than the upper-limit temperature $T_H$ in step S120 (NO in step S120), the determiner 23 determines whether the liquid level detector 172 and the liquid level detector 175 are off in step S130.

When the determiner 23 determines that the liquid level detectors 172, 175 are off in step S130 (YES in S130), the liquid level controller 25 supplies the ink IK up to the first total ink amount 201 in step S140. Specifically, when the liquid level detectors 172, 175 are off, the liquid levels in the upper ink tank 101 and the lower ink tank 109 are lower than the liquid level corresponding to the ink circulation standard amount Vs. Accordingly, the liquid level controller 25 supplies the ink to the lower ink tank 109 in such an ink supply amount 206 that the total ink amount Vt in the ink circulation passage 107 may reach the first total ink amount 201.

Meanwhile, when the controller 2 determines that the ink temperature $T_1$ is lower than the lower-limit temperature $T_L$ or higher than the upper-limit temperature $T_H$ in step S120 (YES in step S120), the determiner 23 determines whether the liquid level detectors 172, 175 are off in step S150.

When the determiner 23 determines that the liquid level detectors 172, 175 are off in step S150 (YES in step S150), the ink amount calculator 21 calculates the total ink amount Vt in the ink circulation passage 107 in step S160 on the basis of the ink consumption amount calculated in step S110 and the preset ink circulation standard amount Vs. Specifically, the ink amount calculator 21 calculates the total ink amount Vt by subtracting the ink consumption amount from the ink circulation standard amount Vs.

Next, in step S170, the determiner 23 determines whether the calculated total ink amount Vt in the ink circulation passage 107 is less than the ink circulation necessary amount Vn.

When the determiner 23 determines that the total ink amount Vt is less than the ink circulation necessary amount Vn in step S170 (YES in S170), the liquid level controller 25 supplies the ink IK up to the second total ink amount 203 in step S180. Specifically, the liquid level controller 25 supplies the ink IK to the lower ink tank 109 only in such an ink supply amount 205 that the total ink amount Vt in the ink circulation passage 107 can be increased to the second total ink amount 203 while being kept below the ink circulation standard amount Vs.

The determination of step S120 in the embodiment is not necessary and this step may be omitted. In this case, after the ink consumption amount is calculated in step S110, the processing proceeds to step S150 to determine whether both of the liquid level detectors 172, 175 are off.

As described above, the inkjet printer 1 of the first embodiment of the present invention includes: the ink amount calculator 21 configured to calculate the consumption amount of ink ejected by the inkjet heads 110 and to calculate the total ink amount Vt in the ink circulation passage on the basis of the calculated ink consumption amount and the ink circulation standard amount Vs; the determiner 23 configured to, when the liquid levels in the upper ink tank 101 and the lower ink tank 109 are determined to be lower than the liquid level corresponding to the ink circulation standard amount Vs from the detection results of the liquid level detectors 172, 175, determine whether the total ink amount Vt calculated by the ink amount calculator 21 is less than the ink circulation necessary amount Vn which is the minimum amount of ink necessary for the circulation of ink in the ink circulation passage 107; and a liquid level controller 25 configured to, when the determiner 23 determines that the total ink amount Vt is less than the ink circulation necessary amount Vn, supply the ink IK from the ink bottle 103 to the lower ink tank 109 in such an amount that the total ink amount Vt is kept below the ink circulation standard amount Vs. Moreover, the amount of the ink IK to be supplied to the lower ink tank 109 is restricted as necessary. This can reduce the time necessary for adjusting the ink IK to an appropriate temperature in a simple configuration without, for example, providing additional one liquid level detector for detecting the ink circulation necessary amount Vn in each of the upper ink tank 101 and the lower ink tank 109.

SECOND EMBODIMENT

In the first embodiment of the present invention, whether the total ink amount Vt is less than the ink circulation necessary amount Vn is determined in printing. However, present invention is not limited to this.

An inkjet printer 1A of a second embodiment of the present invention determines whether the total ink amount Vt is less than the ink circulation necessary amount Vn and reduces the total ink amount Vt in advance according to an estimated time to turn off the power (estimated power-off time) to reduce the time necessary for adjusting the ink IK to an appropriate temperature after the power on.

Figure 5:
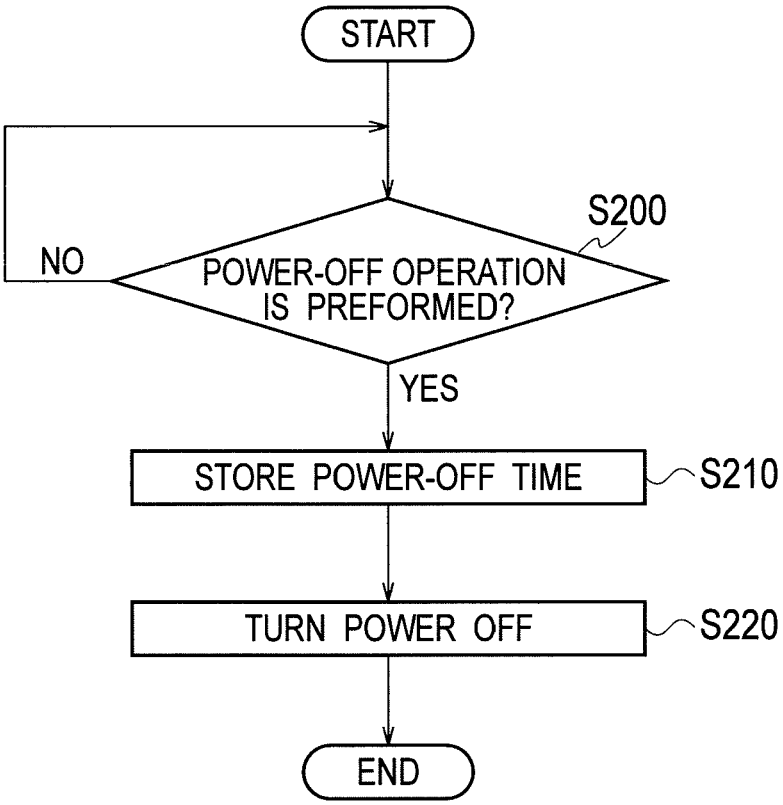
FIG. 5 is a flowchart of power-off processing in the inkjet printer of the second embodiment of the present invention.

FIG. 5 is a flowchart of power-off processing in the inkjet printer 1A of the second embodiment of the present invention. Note that an apparatus configuration of the inkjet printer 1A of the second embodiment of the present invention is the same as the configuration of the inkjet printer 1 of the first embodiment shown in FIGS. 1 to 3 and description thereof is thereby omitted.

As shown in FIG. 5, when the power-off operation is performed from the operation unit 3 of the inkjet printer 1A in step S200 (YES in S200), in step S210, the storage controller 29 stores, in the hard disk 71, the time timed by the clock at a point when the power-off operation from the operation unit 3 is performed, the clock being included in the storage controller 29.

Then, in step S220, the inkjet printer 1A executes shutdown processing and then turns the power off.

The time timed at the point when the power-off operation is performed from the operation unit 3 can be thus stored in the hard disk 71. Accordingly, the processing of reducing the total ink amount Vt in advance can be started based on the stored time according to the estimated power-off time.

Figure 6:
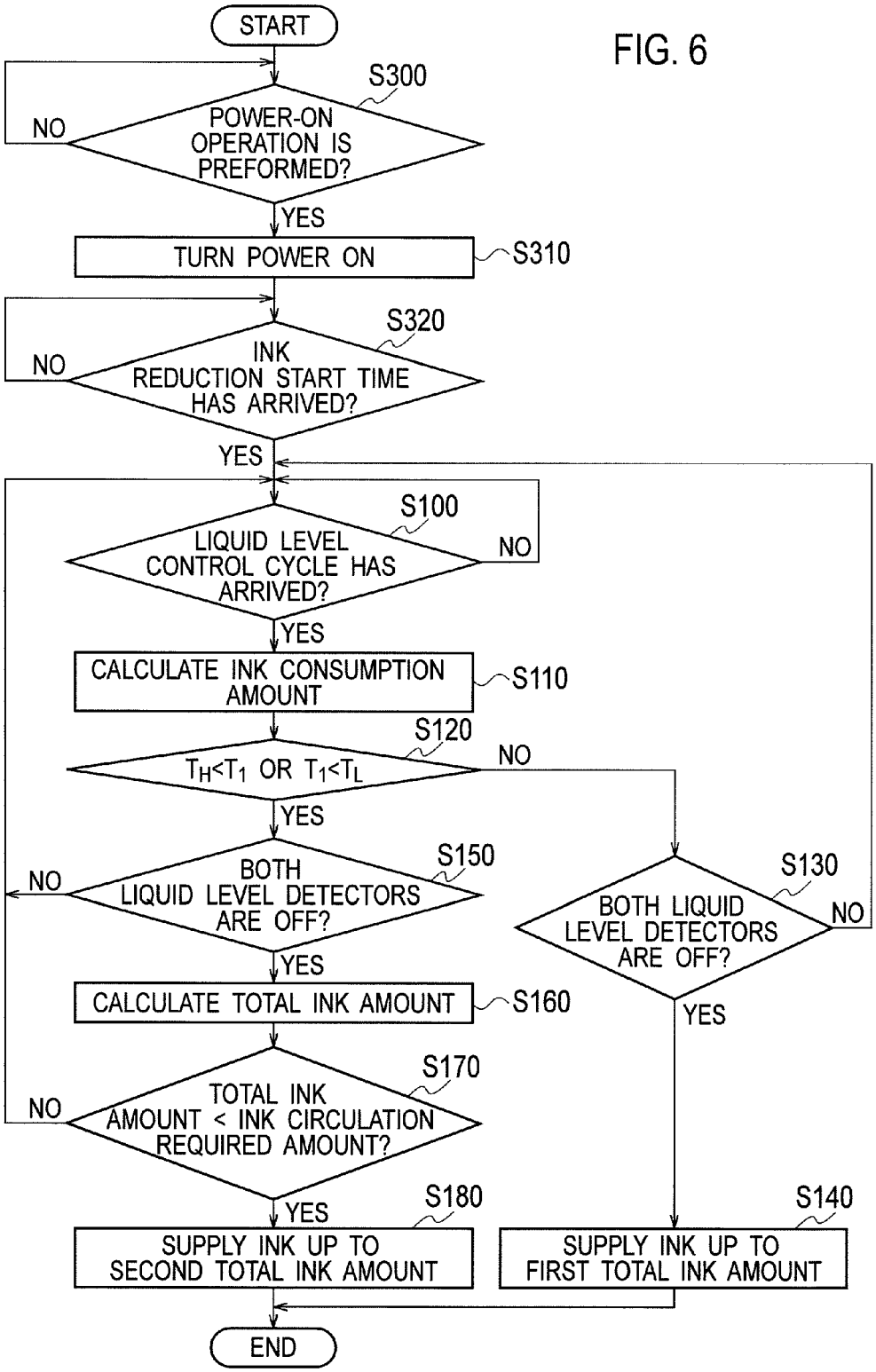
FIG. 6 is a flowchart showing a processing procedure in the inkjet printer of the second embodiment of the present invention.

FIG. 6 is a flowchart showing a processing procedure in the inkjet printer 1A of the second embodiment of the present invention. Note that description of processing steps in the flowchart shown in FIG. 6 which are denoted by the same step numbers as the processing steps in the flowchart shown in FIG. 4 of the inkjet printer 1 of the first embodiment of the present invention are omitted because the processing contents thereof are the same as those of the processing steps in FIG. 4.

As shown in FIG. 6, when the power-on operation is performed from the operation unit 3 of the inkjet printer 1A in step S300 (YES in step S300), the controller 2 turns the power on and performs an activation operation in step S310.

Next, in step S320, the determiner 23 of the controller 2 determines whether an ink reduction start time has arrived, on the basis of time information stored in the hard disk 71, the ink reduction start time being earlier than the time of the power off by a pre-adjustment time. Here, the pre-adjustment time is a time defining how much time the processing for reducing the total ink amount is to be executed in advance before the estimated power-off time, and is preset to, for example, 1 (hour).

For example, in a case where the time of the power off stored in the hard disk 71 is "10:00:00" (ten o'clock) and the pre-adjustment time is "1 (hour)", the determiner 23 sets "9:00:00" (nine o'clock) as the ink reduction start time and executes processing from step S100 at "9:00:00" everyday.

Since the processing from step S100 is the same as the processing shown in the flowchart shown in FIG. 4 of the inkjet printer 1 of the first embodiment of the present invention, description thereof is omitted.

As described above, in the inkjet printer 1A of the second embodiment of the present invention, when the ink reduction start time, which is set to be earlier than the time of the power off by the predetermined time on the basis of the time information stored in the hard disk 71, arrives next time, the liquid level controller 25 determines whether the total ink amount Vt calculated by the ink amount calculator 21 is less than the ink circulation necessary amount Vn. Accordingly, it is possible to determine whether the total ink amount Vt is less than the ink circulation necessary amount Vn and to start the processing of reducing the total ink amount Vt in advance according to the estimated power-off time. When the power is turned on next time, since the total ink amount Vt has been already reduced due to this processing, the time necessary from the power on to completion of adjusting the ink IK to an appropriate temperature can be reduced.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head configured to eject ink to a print medium;

an ink circulation passage including an ink tank configured to store the ink, the ink circulation passage being configured to circulate the ink between the inkjet head and the ink tank;

a liquid level detector provided in the ink tank and configured to detect whether a liquid level of the ink in the ink tank has reached or exceeded a liquid level corresponding to an ink circulation standard amount being a standard for ink circulation;

an ink bottle configured to supply the ink to the ink tank;

an ink amount calculator configured to calculate a total ink amount in the ink circulation passage on a basis of the ink circulation standard amount and a consumption amount of the ink ejected by the inkjet head;

a determiner configured to, when the liquid level detector detects that the liquid level of the ink in the ink tank is lower than the liquid level corresponding to the ink circulation standard amount, determine whether the total ink amount calculated by the ink amount calculator is less than an ink circulation necessary amount being an amount necessary for circulation of the ink in the ink circulation passage; and a controller configured to, when the determiner determines that the total ink amount is less than the ink circulation necessary amount, perform ink supply amount control to supply the ink from the ink bottle to the ink tank in such an amount that the total ink amount is kept below the ink circulation standard amount.

2. The inkjet printer according to claim 1, further comprising:

a thermometer configured to measure a temperature of the ink circulating in the ink circulation passage; and a storage unit configured to store the temperature of the ink measured by the thermometer in association with time-series change, wherein the determiner is further configured to determine whether the temperature of the ink stored in the storage unit has deviated from a range of an ejection appropriate temperature in a predetermined period, the ejection appropriate temperature being a temperature of the ink at which the ink has a viscosity necessary for appropriate ejection from the inkjet head, and the controller is configured to perform the ink supply amount control only when the determiner determines that the temperature of the ink has deviated from the range of the ejection appropriate temperature.

* * * * *